US006386148B1

(12) United States Patent
Watts

(10) Patent No.: US 6,386,148 B1
(45) Date of Patent: May 14, 2002

(54) STEAM-RAISING SYSTEM

(75) Inventor: Robert John Watts, Kent (GB)

(73) Assignee: Eaton-Williams Group Limited, Kent (GB)

( * ) Notice: Subject to any disclaimer, the term of this patent is extended or adjusted under 35 U.S.C. 154(b) by 0 days.

(21) Appl. No.: 09/680,285

(22) Filed: Oct. 6, 2000

(30) Foreign Application Priority Data

Oct. 8, 1999 (GB) ..... 9923786

(51) Int. Cl.[7] ..... F22D 5/28
(52) U.S. Cl. ..... 122/452; 122/40
(58) Field of Search ..... 122/40, 452; 417/10.1, 417/300, 415, 398, 399, 269, 222.1, 222.2

(56) References Cited

U.S. PATENT DOCUMENTS 922,790 A * 5/1909 MacLachlan ..... 122/452
3,878,680 A * 4/1975 Dauvergne ..... 60/511
3,918,846 A * 11/1975 Winkler ..... 417/269
4,071,079 A * 1/1978 Engelbrecht ..... 122/40
4,177,020 A * 12/1979 Chadwick ..... 417/379
4,938,173 A * 7/1990 Hopkinson ..... 122/40
5,064,351 A * 11/1991 Hamey et al. ..... 417/222.2
5,145,326 A * 9/1992 Kimura et al. ..... 417/222.2
5,515,829 A * 5/1996 Wear et al. ..... 417/222.1
5,666,910 A * 9/1997 George, II et al. ..... 122/40
5,975,863 A * 11/1999 Mazzucato ..... 417/269

* cited by examiner

*Primary Examiner*—Gregory Wilson
(74) *Attorney, Agent, or Firm*—Clark & Brody

(57) ABSTRACT

A steam-raising system comprising a boiler having (a) a passageway for water and/or steam, (b) an inlet to the passageway through which water is introduced continuously for given periods when the boiler is in use, (c) a burner to heat the passageway from the outside thereof, and (d) an outlet from the passageway from which steam emerges continuously as water is introduced through the inlet. The system further comprises a pump connected by a flow-path to the said inlet to pump water thereto along the said flow-path. The pump is a variable-flow-rate pump constructed to provide a flow-rate through it which is substantially independent of its downstream pressure.

13 Claims, 2 Drawing Sheets

STEAM-RAISING SYSTEM

TECHNICAL FIELD

The present invention relates to a steam-raising system comprising a boiler having (a) a passageway for water and/or steam, (b) an inlet to the passageway through which water is introduced continuously for given periods when the boiler is in use, (c) a burner to heat the passageway from the outside thereof, and (d) an outlet from the passageway from which steam emerges continuously as water is introduced through the inlet, the system further comprising a pump connected by a flow-path to the said inlet to pump water thereto along the said flow-path.

BACKGROUND ART

EP-A-727,609 describes such a system with flow-control means comprising a plurality of lines which constitute a part of the flow-path, which are connected between the pump and boiler in parallel with one another, and which are independently openable to enable the amount of water delivered to the boiler to be varied, each line having a shut-off valve and a flow regulator which maintains a constant flow through it substantially independently of the pressures upstream of its inlet and downstream of its outlet.

A disadvantage of this previously proposed system is the relatively crude control obtained by switching in or out one or more of the lines, and the relatively high expense involved in having a shut-off valve and a further regulator for each line.

The present invention seeks to obviate this disadvantage.

SUMMARY OF THE INVENTION

Accordingly, the present invention is directed to a steam raising system as set out in the opening paragraph of the present specification, in which the pump is a variable-flow-rate pump constructed to provide a flow-rate through it which is substantially independent of its downstream pressure.

Advantageously, heated water is fed to the pump, preferably via a further pump upstream of the first-mentioned pump to create an upstream pressure sufficient to avoid cavitation therein.

Conveniently, the water fed to the first-mentioned pump is heated by means of some of the steam which emerges from the boiler.

The first-mentioned pump may be an electrically operated pump, preferably operated by an alternating electrical current, advantageously constructed so that the flow-rate is dependent upon the frequency of the alternating current. In that case control means may be provided to vary the frequency in dependence upon the required flow-rate of water to the boiler.

The first-mentioned pump may comprise a plurality of piston and cylinder arrangements, each connected to draw in water from a water source during a first stroke and then to pump it through an outlet of the pump during a second stroke, the arrangements being in suitably different phases relative to one another to obtain a continuous supply of water from the outlet.

The pistons may be moved by means of a rotary surface which slants relative to an axis of the pump to which at least components of the longitudinal extent of the cylinders of the piston and cylinder arrangements are substantially parallel.

Temperature monitoring means may be provided downstream of the boiler to measure the temperature of the steam output of the boiler.

The temperature monitoring means may be connected to a control unit of the system which adjusts the flow-rate of the first-mentioned pump in dependence upon the measured temperature of the steam output of the boiler.

The control unit may thereby maintain a given flow-rate or a given head of steam output.

The present invention extends to a method of raising steam by a system in accordance with the present invention.

BRIEF DESCRIPTION OF THE DRAWINGS

An example of a steam-raising system in accordance with the present invention will now be described with reference to the accompanying drawings, in which.

DETAILED DESCRIPTION OF THE PREFERRED EMBODIMENT

Figure 1:
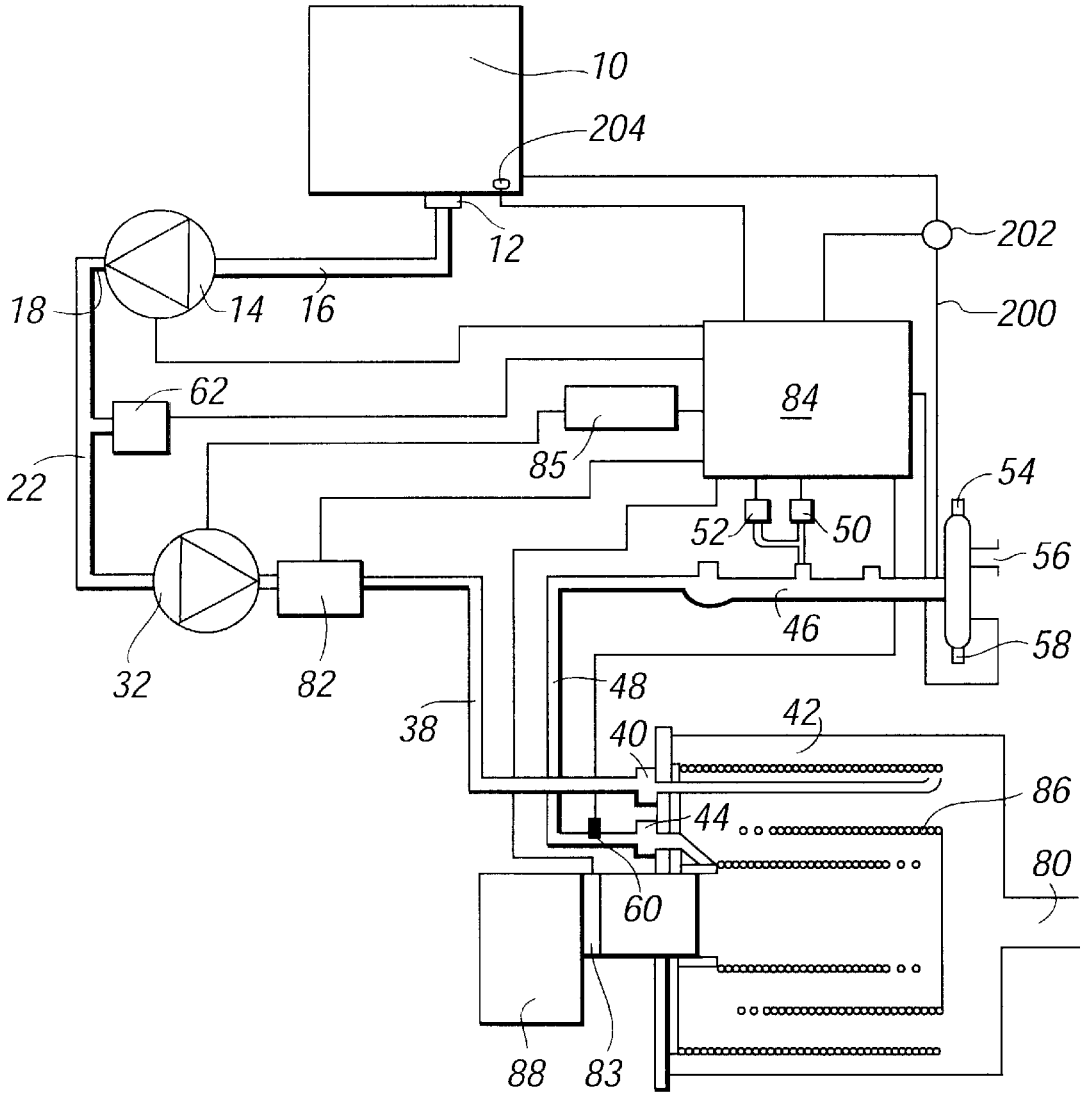
FIG. 1 shows a circuit diagram of the system.

The system shown in FIG. 1 comprises a boiler feed tank 10 having an outlet 12 which is connected to the input of a pump 14 via a passageway 16. The output 18 from the pump 14 is connected to a feed line 22.

The feed line 22 feeds water under pressure to a frequency-controlled alternating-current electrically operated variable flow-rate pump 32 which is constructed in a manner to be described with reference to FIG. 2 so that it provides a flow-rate of water through it which is substantially independent of its downstream pressure, and also independent of its upstream pressure.

The pump 32 feeds water to a water inlet 40 of a boiler 42 via a flowmeter 82. A steam outlet 44 from the boiler 42 is connected to a header 46 via a steam passageway 48. The header 46 is hollow and is generally T-shaped with the T on its side so that the part of the header corresponding to what is normally upright in the letter T is horizontal. The passageway 48 is connected at its end further from the steam outlet 44 to the base of the T of the header 46. A pressure transducer 50 and a pressure switch 52 are connected to the header 46 so as to be exposed to the pressure therewithin. The header 46 is also provided with a pressure safety valve 54 above the main steam outlet 56 of the header 46, and a header drain valve 58. A temperature sensor 60 is also provided on the passageway 48 as monitoring means to provide a measurement of the temperature of the steam from the boiler 42.

A further pressure safety cut-out switch 62 is connected to the feed line 22 so as to be exposed to the pressure thereof.

Outputs from the pressure transducer 50 and the switches 52 and 62 along with the output from the temperature sensor 60 are all electrically connected to respective inputs of a control unit 84. Outputs therefrom are respectively connected to the pump 14 and, via an inverter 85, to the pump 32.

The control unit 84 also has an input connected to the flowmeter 82, and an output connected to a burner shut-off 83. If the flowrate of water as measured by the flowmeter 82 falls below a predetermined limit, for example 1 litre/min, the control unit will shut off the burner.

The boiler 42 comprises a multi-helical tubular conduit 86 that meanders within the interior of the boiler 42. A burner 88 of the boiler 42 directs a flame within the helices of the tubular conduit 86 to heat up the water and/or steam therewithin. The boiler 42 is also provided with a flue (not shown) for the escape of the combustion gases from the burner 88.

Figure 2:
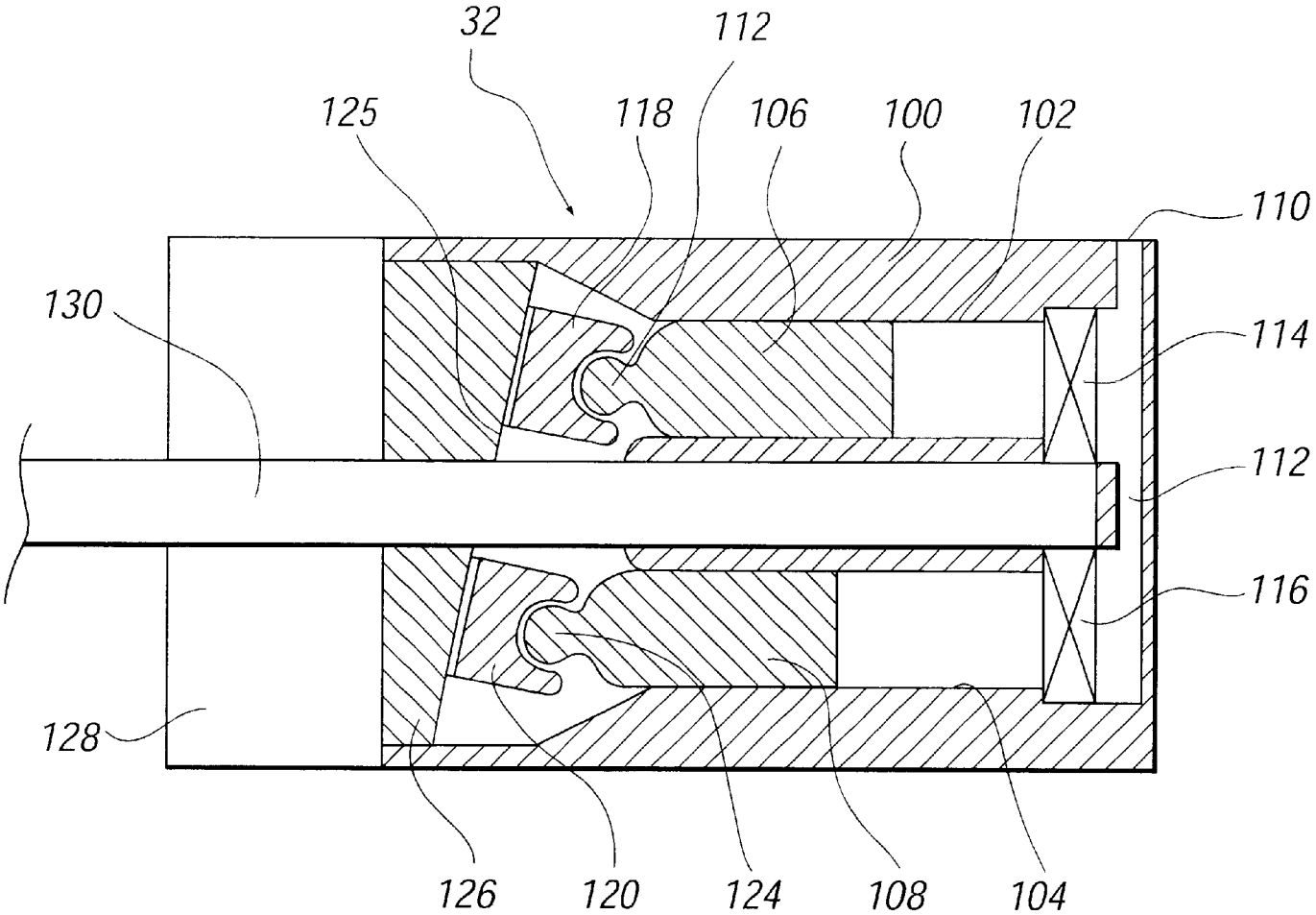
FIG. 2 shows an axial-sectional view through a pump of the system shown in FIG. 1.

Whilst many constructions are possible for the pump 32, FIG. 2 shows one possible construction. It comprises a cylinder block 100 formed with two cylinders 102 and 104 within which respective hollow pistons 106 and 108 are slidable axially. An inlet 110 into the pump 32 communicates with the gallery 112 which in turn communicates with the interiors of the cylinders 102 and 104 via valves 114 and 116 respectively. The pistons 106 and 108 are connected at their ends further from the valves 114 and 116 to respective sliders 118 and 120 via respective ball-and-socket connections 122 and 124. The latter have planar faces on their sides further from the connections which rest against a slanting planar surface 125 of a cam disc 126 such as to be in sliding contact therewith. The latter is coupled to be rotated about an axis of the pump 32 by an alternating-current electrically driven frequency-controlled hollow motor 128. An axially extending outlet passageway 130 is in communication at its inside end with the cylinder interiors via the valves 114 and 116.

As the motor 128 rotates the cam disc 126, the sliders slide over the slanting surface 125. The pressure of water in the gallery 112 urges the piston 108 away from the gallery end of the cylinder 104 as the slider 120 moves to the part of the slanting surface 125 at the thinnest part of the cam disc 126. As the cam disc 126 is rotated further, the piston 108 is pushed towards the gallery 112 as the slider 120 climbs the slanting surface 125. Water is thus urged at a given flow-rate out from the cylinder 104 into the passageway 130 via the valve 116 which has now closed the communication between the gallery 112 and the interior of the cylinder 104 and opened the communication between that interior and the passageway 130. In the meantime, water is entering the interior of the cylinder 102 via the valve 114.

As the pistons 106 and 108 continue their work in this way, water is urged out from the axially extending passageway 130 at a rate determined by the rotary speed of the motor 128, substantially independently of the back pressure in the passageway 130. The flow-rate through the passageway 130 is directly proportional to the rotary speed of the motor 128.

A small amount of the steam from the heater 46 is routed via a passageway 200 with a control valve 202 to the feed tank 10 to heat the water therein to the extent that it will inhibit development of micro-organisms in the tank. The control valve 202 is connected for control by the control unit 84 in dependence upon the temperature of the water in the tank 10 as measured by a temperature sensor 204 therein connected to deliver its output signals to the control unit 84. The control unit 84 ensures that the valve 202 can only open with a sufficient pressure in the header 46 as indicated by the pressure transducer 50.

When the system is in operation, the pump 14 feeds water from the boiler feed tank 10 to the boiler 42 via the passageways 16 and 22, the pump 32, and the passageway 38. The pressure developed by the pump 14 is sufficient to inhibit cavitation occurring in pump 32. With the burner 88 switched on, the boiler 42 heats the water which passes through a helical conduit 86 so that the water becomes superheated steam by the time it exits the outlet 44 from the boiler 42. This superheated steam is then available at the outlet 56 from the header 46 to which the steam is fed from the boiler 42 via the passageway 48.

The pump 32 maintains a constant flow at a rate which, for the given specification of the burner 88, produces superheated steam at the outlet 44 and consequently in the passageway 48 and at the header 46.

Once the temperature as indicated by the temperature sensor 60 exceeds the boiling point of water at the pressure as indicated by the pressure transducer 50 by more than 5° Centigrade, the control unit 84 increases the frequency of the alternating current supplied to the pump 32 by adjusting the inverter 85 to cause an additional amount of water to be fed to the boiler 42 via the flowmeter 82 and the passageway 38 at a rate determined by the increased speed of the pump 32. In the event that the temperature of the steam exceeds the boiling point of water for the pressure as indicated by the pressure transducer 50 by more than 10° Centigrade, the control unit 84 further increases the frequency of the alternating current supplied to the pump 32 thus causing a further amount of water to flow into the passageway 38 via the flowmeter 82, at a flow-rate again determined by the increased speed of the pump 32.

In the event that the temperature of the superheated steam at the temperature sensor 60 falls more than 1° Centigrade below the threshold temperatures for increased flow, the speed of the pump 32 is correspondingly reduced.

Such control enables superheated steam to be provided by the boiler at a given temperature, with a substantially constant pressure.

In the event that the pressure exceeds the predetermined pressure as indicated by the pressure transducer 50, by a predetermined amount, the control unit 84 switches off the burner 88 at the switch 83. It also switches off the pumps 14 and 32. Once the pressure indicated by the pressure transducer 50 falls below the predetermined amount, the system is switched back on by the turning on of the pumps 14 and 32, and the switching on of the burner 88 at the burner switch 83. There may be a hysteresis range between the pressure at which shut-down occurs and the pressure at which the system is switched back on.

In the event that either of the pressure switches 52, or 62 indicate a pressure which exceeds a predetermined value, the control unit 84 will also shut the system down as a safety measure by switching off the pumps 14 and 32 and the burner 88.

Also in the event that the temperature sensor 60 indicates a temperature which exceeds a predetermined value, the control unit 84 will shut the system down as a safety measure.

Numerous variations and modifications to the illustrated system may occur to the reader without taking the resulting modification or variation outside the scope of the present invention. To give one example only, the pump 14 may be omitted if the water in the tank 10 is not heated.

The pump 32 may comprise a Fenner™ F06 pump manufactured by J. H. Fenner & Co. Limited of Ashton Road, Harold Hill, Romford RM3 8UA, England.

The temperature sensor 60 may comprise two temperature sensors, one for regulation and one for safety shut-down.

I claim:

1. A steam-raising system comprising a boiler having (a) a passageway for water and/or steam, (b) and inlet to the passageway through which water is introduced continuously for given periods when the boiler is in use, (c) a burner to heat the passageway from the outside thereof, and (d) an outlet from the passageway from which steam emerges continuously as water is introduced through the inlet, the system further comprising a pump connected by a flow-path to the said inlet to pump water thereto along the said flow-path, wherein the pump is a variable-flow-rate pump constructed to provide a flow-rate through it which is substantially independent of its downstream pressure, temperature monitoring means are provided downstream of the boiler to measure the temperature of the steam output of the boiler, and a control unit is connected to the temperature monitoring means to adjust the flow-rate of the pump in dependence upon the measured temperature of the steam output of the boiler.

2. A steam-raising system according to claim 1, wherein means are provided to feed heated water to the said pump.

3. A steam-raising system according to claim 2, wherein a second pump is arranged upstream of said pump to create an upstream pressure sufficient to avoid cavitation in said pump.

4. A steam-raising system according to claim 1, wherein heating means are provided to heat water which is fed to the said pump, the heating means being connected to receive steam which emerges from the boiler.

5. A steam-raising system according to claim 1, wherein the said pump comprises an electrically operated pump.

6. A steam-raising system according to claim 5, wherein the electrically operated pump is operated by an alternating electrical current.

7. A steam-raising system according to claim 1, wherein the said pump comprises a plurality of piston and cylinder arrangements, each connected to draw in water from a water source during a first stroke and then to pump it through an outlet of the pump during a second stroke, the arrangements being in suitably different phases relative to one another to obtain a continuous supply of water from the outlet.

8. A steam-raising system according to claim 7, wherein the pistons are moved by means of a rotary surface which slants relative to an axis of the pump to which at least components of the longitudinal extent of the cylinders of the piston and cylinder arrangements are substantially parallel.

9. A steam-raising system according to claim 1, wherein the control unit thereby maintains a given flow-rate.

10. A steam-raising system according to claim 1, wherein the control unit thereby maintains a given head of steam output.

11. A method of raising steam by a system as claimed in claim 1.

12. A steam-raising system comprising a boiler having (a) a passageway for water and/or steam, (b) and inlet to the passageway through which water is introduced continuously for given periods when the boiler is in use, (c) a burner to heat the passageway from the outside thereof, and (d) an outlet from the passageway from which steam emerges continuously as water is introduced through the inlet, the system further comprising a pump connected by a flow-path to the said inlet to pump water thereto along the said flow-path, wherein the pump is a variable-flow-rate pump constructed to provide a flow-rate through it which is substantially independent of its downstream pressure, the said pump comprises an electrically operated pump, the electrically operated pump is operated by an alternating electrical current, and the electrically operated pump is constructed so that the flow-rate is dependent upon the frequency of the alternating current.

13. A steam-raising system according to claim 12, wherein control means are provided to vary the frequency in dependence upon the required flow-rate of water to the boiler.

* * * * *